US010723506B2

(12) United States Patent
Tsao

(10) Patent No.: US 10,723,506 B2
(45) Date of Patent: Jul. 28, 2020

(54) SIMPLE PAPER BEVERAGE-FOOD BOX

(71) Applicant: E-PACKAGE CREATION & SOLUTION MANUFACTURING CORP., Taipei (TW)

(72) Inventor: Chung-Piao Tsao, Taipei (TW)

(73) Assignee: E-PACKAGE CREATION & SOLUTION MANUFACTURING CORP., Taipei (TW)

( * ) Notice: Subject to any disclaimer, the term of this patent is extended or adjusted under 35 U.S.C. 154(b) by 0 days.

(21) Appl. No.: 16/168,796

(22) Filed: Oct. 23, 2018

(65) Prior Publication Data

US 2020/0122879 A1 Apr. 23, 2020

(51) Int. Cl.

| | |
|---|---|
| ***B65D 5/42*** | (2006.01) |
| ***B65D 5/32*** | (2006.01) |
| ***B65D 5/50*** | (2006.01) |
| ***B65D 5/14*** | (2006.01) |

(52) U.S. Cl.

CPC ..... *B65D 5/4208* (2013.01); *B65D 5/14* (2013.01); *B65D 5/326* (2013.01); *B65D 5/4279* (2013.01); *B65D 5/5059* (2013.01)

(58) Field of Classification Search

CPC ..... B65D 5/14; B65D 5/4266

USPC ..... 229/103.1, 122.27, 122.29–122.31, 119, 229/122.2, 404, 904, 920, 930–931, 229/198.2, 122.34; 206/562, 563, 217, 206/218, 486, 488, 489, 418; 220/738

See application file for complete search history.

(56) References Cited

U.S. PATENT DOCUMENTS 925,935 A * 6/1909 Miner ..... B65D 5/14 229/122.28
1,282,656 A * 10/1918 Tiede ..... B65D 85/32 217/29
1,997,777 A * 4/1935 Joyce ..... B65D 5/5038 206/418
2,186,111 A * 1/1940 Kavanaugh ..... B65D 5/4295 229/114
2,870,461 A * 1/1959 Rosenthal ..... A47D 13/06 5/93.1
5,054,684 A * 10/1991 Farber ..... B65D 5/701 215/388

(Continued)

FOREIGN PATENT DOCUMENTS

CA 2637426 A1 * 1/2010 ..... B65D 5/566

*Primary Examiner* — Nathan J Newhouse
*Assistant Examiner* — Phillip Schmidt
(74) *Attorney, Agent, or Firm* — Leong C. Lei

(57) ABSTRACT

A simple paper food-beverage box comprises a box-body and a box-bottom-body combined in the box-body; wherein the box-body is provided for placing the food, which the box-body and the box-bottom-body respectively set a plurality of first folding-lines to provide folding storage; wherein the box-bottom-body has a predetermined distance from the bottom surface of the periphery of the box-body, and the bottom of each of the first folding-line is set with a first incision; wherein the box-bottom-body is set with a first through-hole, thereby providing for sticking and engaging a beverage cup on the bottom surface of the box-bottom-body; wherein the periphery of the cup-mouth of the beverage cup is stuck and engaged by the periphery of the box-body, and the straw of the beverage cup can extend out through the first through-hole.

4 Claims, 7 Drawing Sheets

(56) References Cited

U.S. PATENT DOCUMENTS

| | | | | |
|---|---|---|---|---|
| 5,320,065 | A * | 6/1994 | Leopold | A01K 1/035<br>119/498 |
| 6,132,349 | A * | 10/2000 | Yokoyama | B31F 1/0012<br>493/86 |
| 9,884,700 | B2 * | 2/2018 | Kao | B65D 15/08 |

* cited by examiner

SIMPLE PAPER BEVERAGE-FOOD BOX

TECHNICAL FIELD OF THE INVENTION

The present invention relates to a meal box, and especially relates to a simple paper beverage-food box having a folding function, and the bottom can provide for combining with a beverage cup.

DESCRIPTION OF THE PRIOR ART

The food accommodating grooves of the conventional meal box are made by using the mold to pressurize. However, due to the process, the structure is simply the changes in the meal grid number and the shape, so that the conventional meal box can only provide for placing the food; and the structure is fixed, so it is difficult to stack and store.

SUMMARY OF THE INVENTION

In view of the above-mentioned shortcomings, the simple paper food-beverage box of the of the present invention comprises a box-body and a box-bottom-body combined in the box-body; wherein the box-bottom-body has a predetermined distance from the bottom surface of the periphery of the box-body, and the bottom of each of the first folding-line is set with a first incision; wherein the box-bottom-body is set with a first through-hole, thereby providing for sticking and engaging a beverage cup on the bottom surface of the box-bottom-body; wherein the periphery of the cup-mouth of the beverage cup is stuck and engaged by the periphery of the box-body, and the straw of the beverage cup can extend out through the first through-hole.

DETAILED DESCRIPTION OF THE PREFERRED EMBODIMENTS

The following descriptions are exemplary embodiments only, and are not intended to limit the scope, applicability or configuration of the invention in any way. Rather, the following detailed description provides a convenient illustration for implementing exemplary embodiments of the invention.

Various changes to the described embodiments may be made in the function and arrangement of the elements described without departing from the scope of the invention as set forth in the appended claims.

The foregoing and other aspects, features, and utilities of the present invention will be best understood from the following detailed description of the preferred embodiments when read in conjunction with the accompanying drawings.

Figure 1:
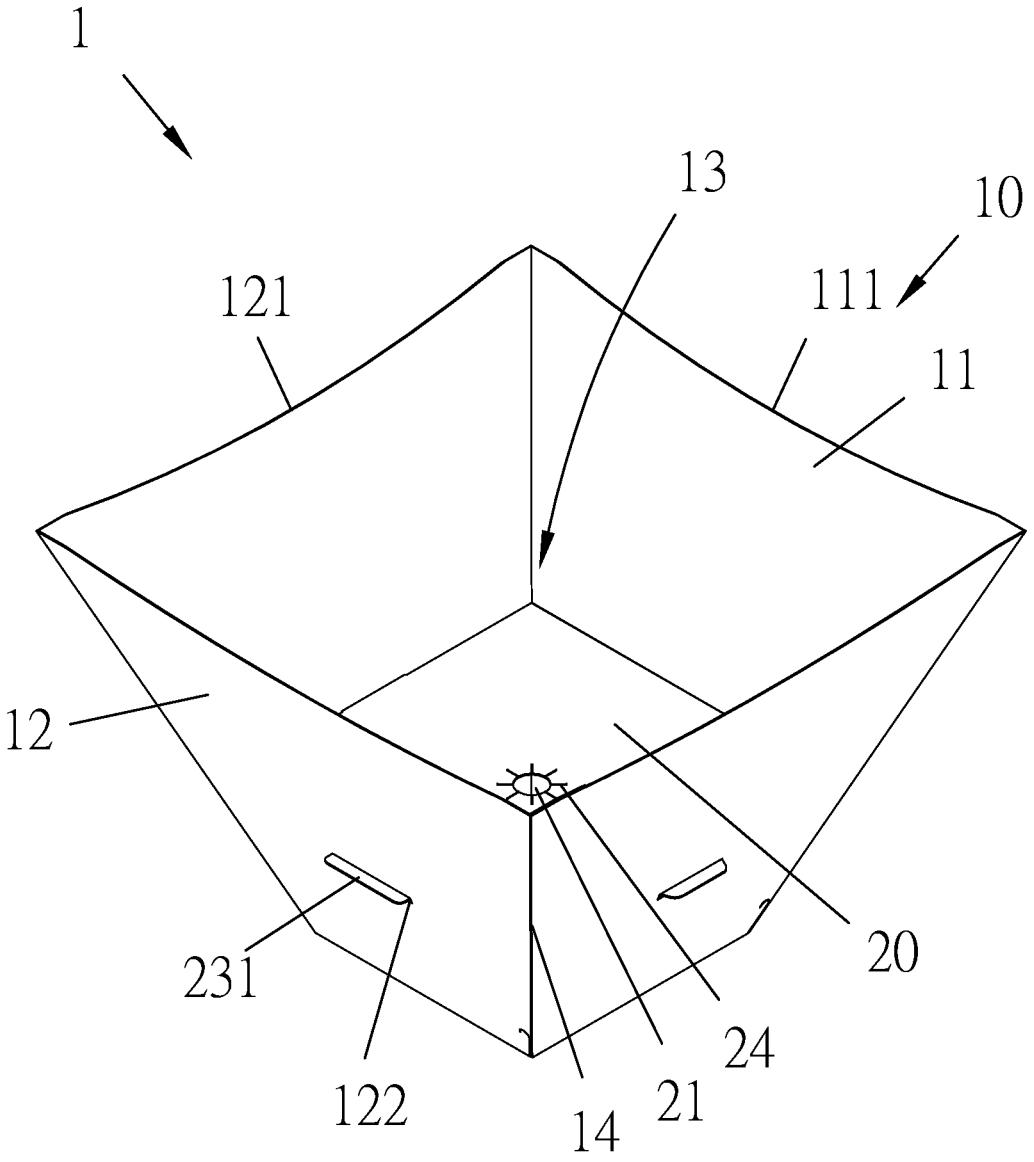
FIG. 1 is a stereoscopic appearance diagram of the first embodiment of the present invention.
Figure 2:
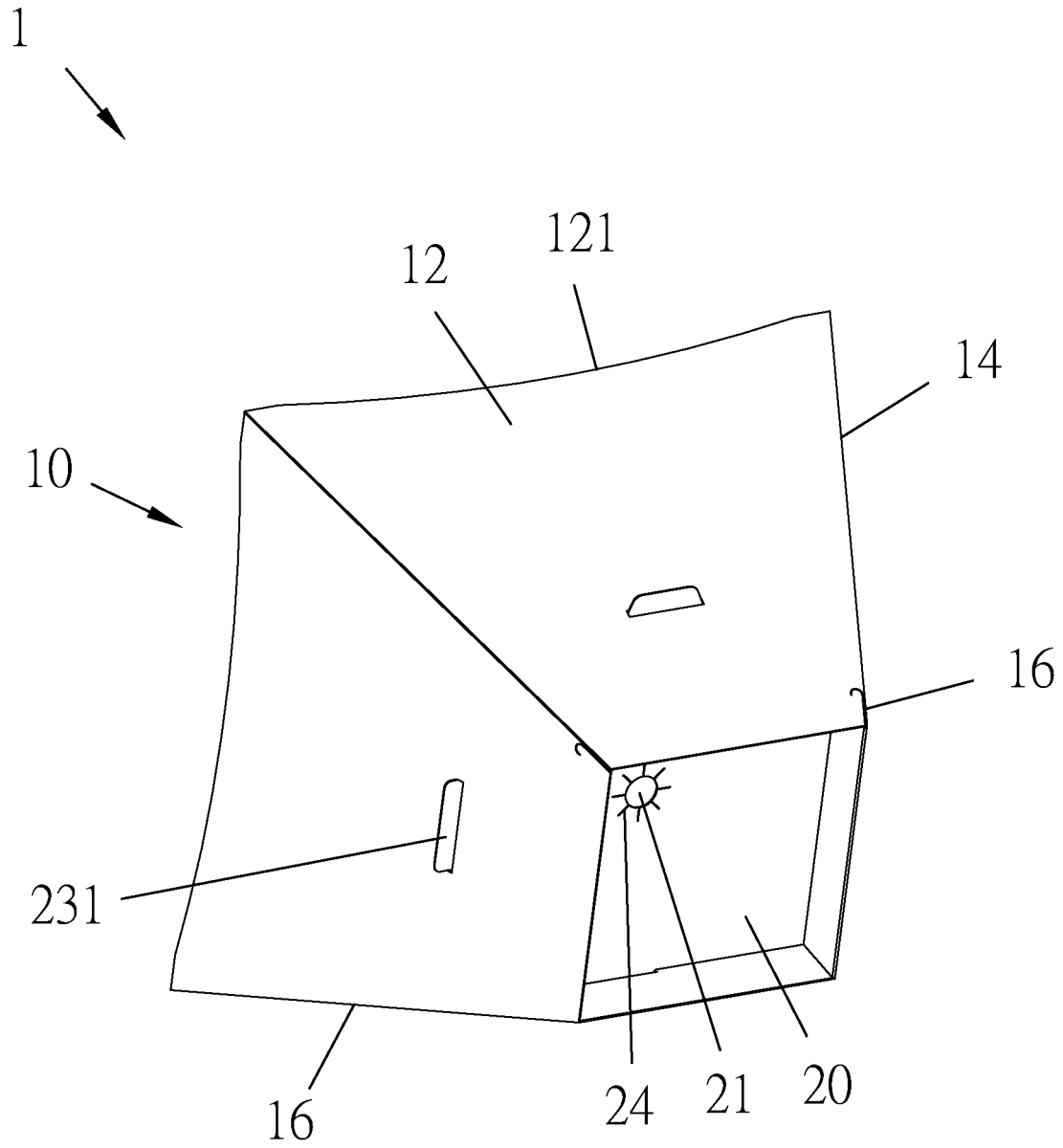
FIG. 2 is a stereoscopic appearance diagram of another perspective continuing FIG. 1.
Figure 3:
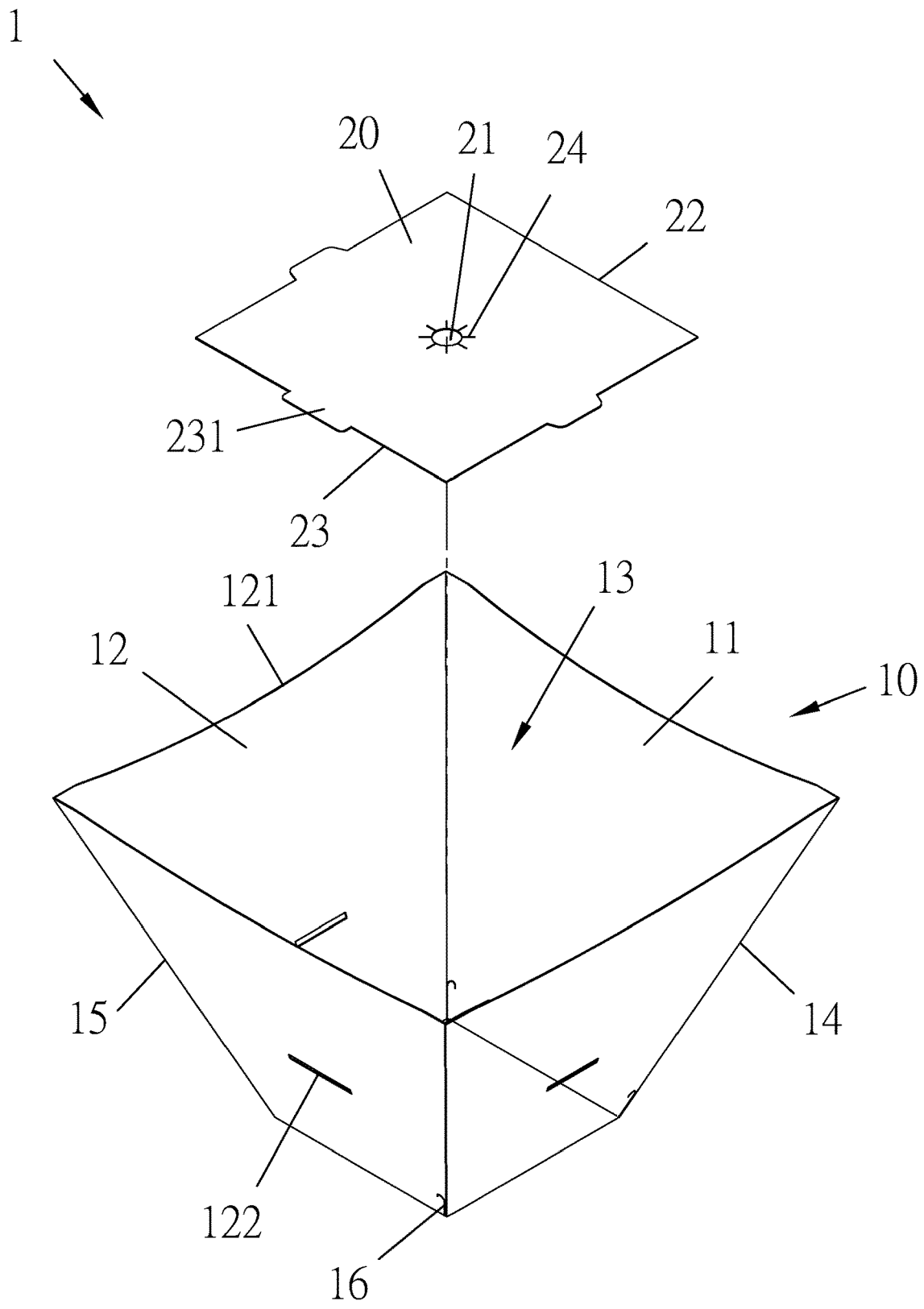
FIG. 3 is an exploded perspective view of the first embodiment of the present invention.

Please refer to FIG. 1 to FIG. 3, which is a simple paper food-beverage box 1 of the first embodiment of the present invention and comprises a box-body 10 and a box-bottom-body 20. The components are respectively described as follows:

The box-body 10 comprises a first side-portion 11 and a plurality of second side-portions 12; wherein the first side-portion 11 and each of the second side-portions 12 are connected with each other to form an accommodating space 13 inside; and the top of the first side-portion 11 and the top of each of the second side-portions 12 have a concave-portion 111, 121.

Between the first side-portion 11 and each of the second side-portions 12 respectively has a first folding-line 14, and between each of the second side-portions 12 respectively has a second folding-line 15; wherein the bottom of each of the first folding-line 14 and second folding-line 15 respectively has a first incision 16; and a predetermined position of each of the second side-portions 12 is set with a combining slot 122; wherein the top end of each first incision 16 has an arc portion to prevent the first incision 16 from being torn toward each of the first folding-line 14 and each of the second folding-line 15.

The box-bottom-body 20 comprises a first through-hole 21, a first edge-portion 22, and a plurality of second edge-portions 23; wherein the first through-hole 21 is set at the center of the box-bottom-body 20, and a plurality of second incisions 24 are set at the edge of the first through-hole 21 of the box-bottom-body 20 in interval.

The first edge-portion 22 is combined with the first side-portion 11; and each of the second edge-portions 23 is convexly set a combining-piece 231 respectively; wherein each of the combining-piece 231 is inserted and set in each of the combining slot 122; wherein the bottom surface of the box-bottom-body 20 has a predetermined distance from the bottom surface of the first side-portion 11 and the bottom surface of each of the second side-portions 12.

Figure 4:
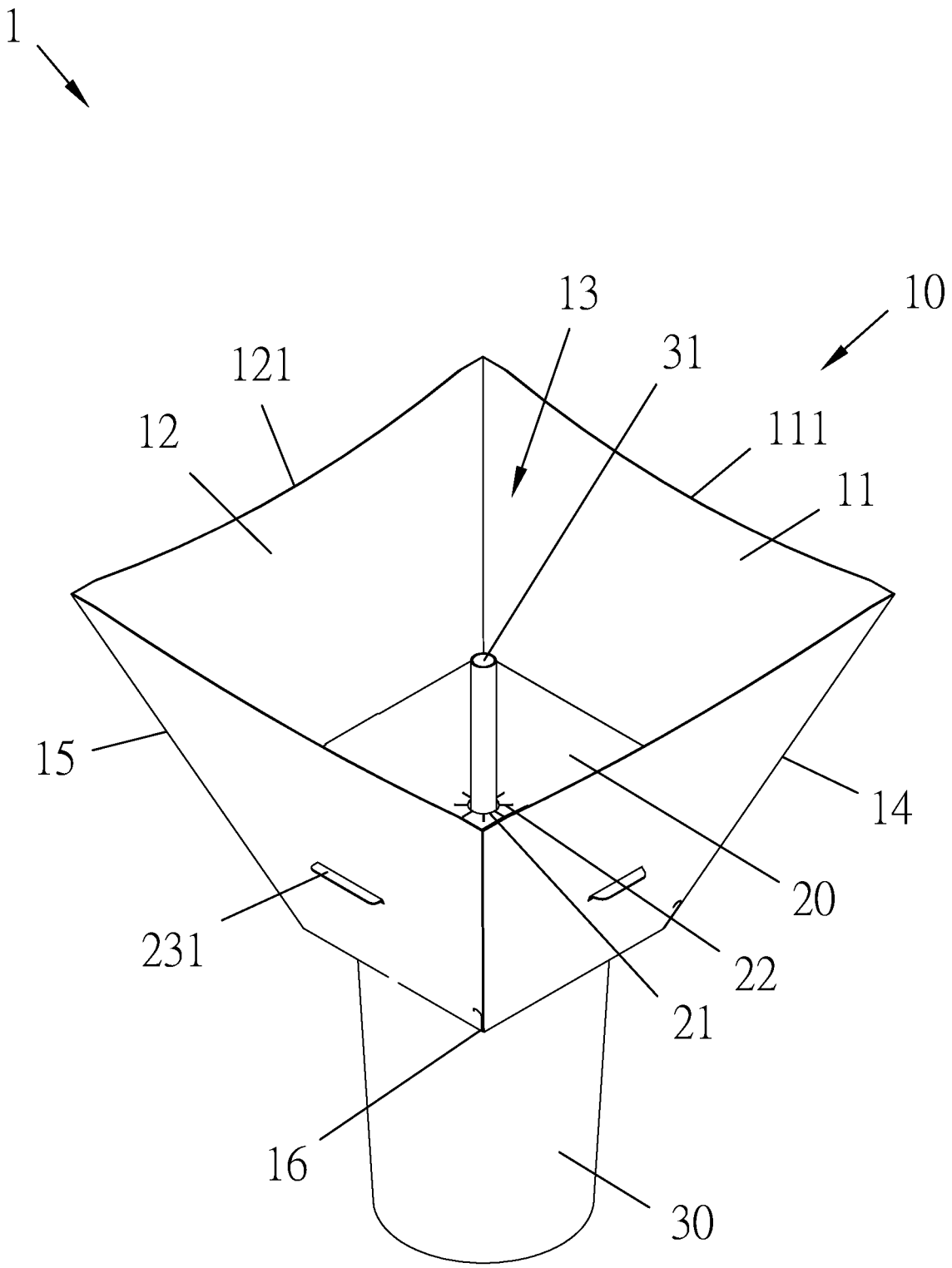
FIG. 4 is a usage state schematic diagram of the present invention.

Please refer to FIG. 4, when the paper food-beverage box 1 of the present invention is used, the beverage cup 30 is stuck and engaged on the bottom surface of the box-bottom-body 20; wherein the periphery of the cup-mouth of the beverage cup 30 is stuck and engaged by the periphery of the box-body 10. Since the box-body 10 is set with a plurality of first incisions 16, the bottoms of the first side-portion 11 and the second side-portions 12 can be enlarged and restored to have elasticity; so that the beverage cup 30 can be stuck and engaged stably; and the straw 31 of the beverage cup 30 is extended out through the first through-hole 21.

Figure 5:
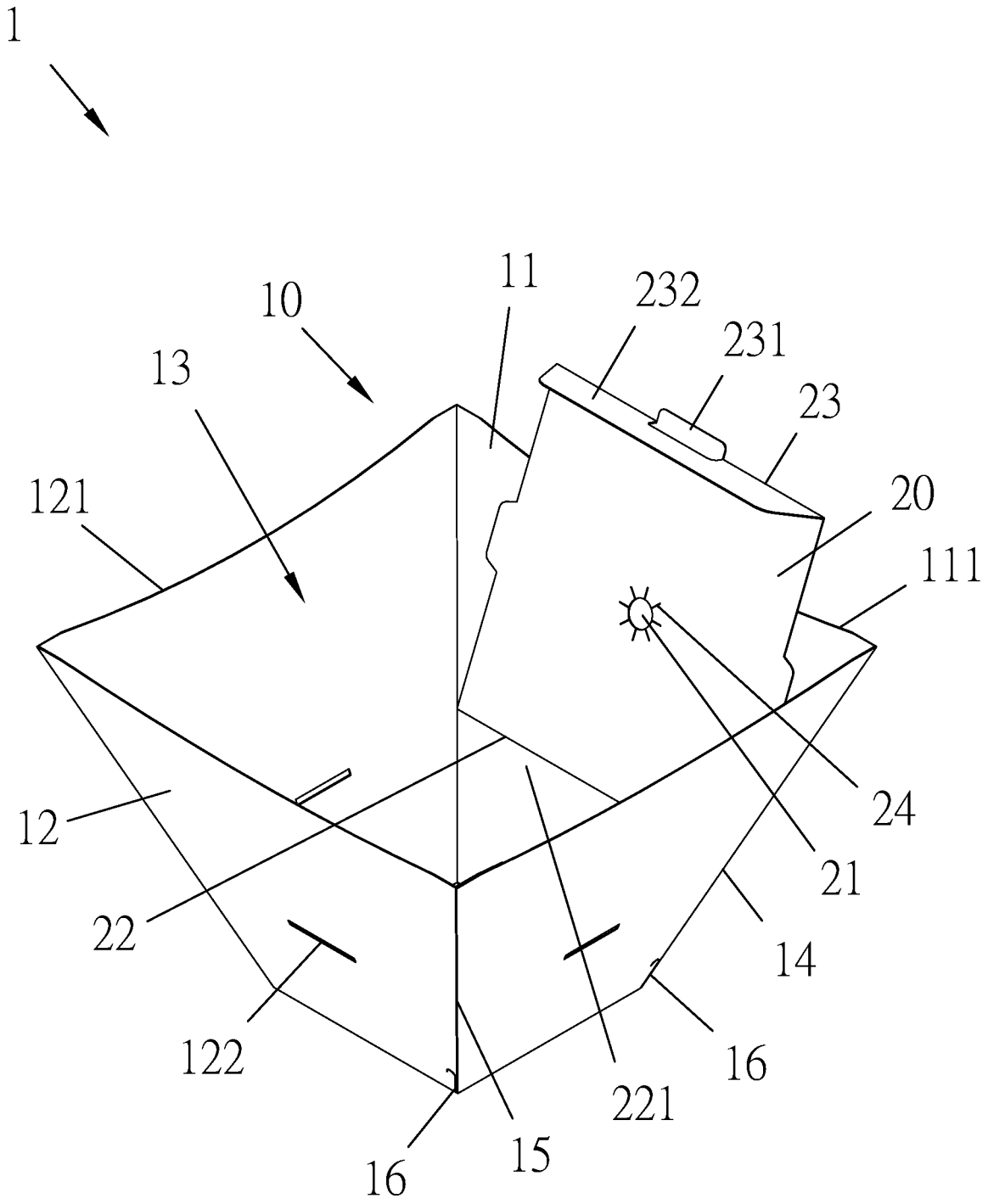
FIG. 5 is a stereoscopic appearance diagram of the second embodiment of the present invention.

Please refer to FIG. 5, which shows the paper food-beverage box 1 of the second embodiment of the present invention and its main structure is the same as aforementioned structure; so the same places will not be further described again.

In this embodiment, the first edge-portion 22 of the box-bottom-body 20 is set with a first bending-portion 221; wherein the first bending-portion 221 is abutted against the first side-portion 11 to combine; wherein the second edge-portion 23 of the box-bottom-body 20 is set with a second bending-portion 232, and the second bending-portion 232 is abutted against the second side-portions 12 to combine.

Figure 6:
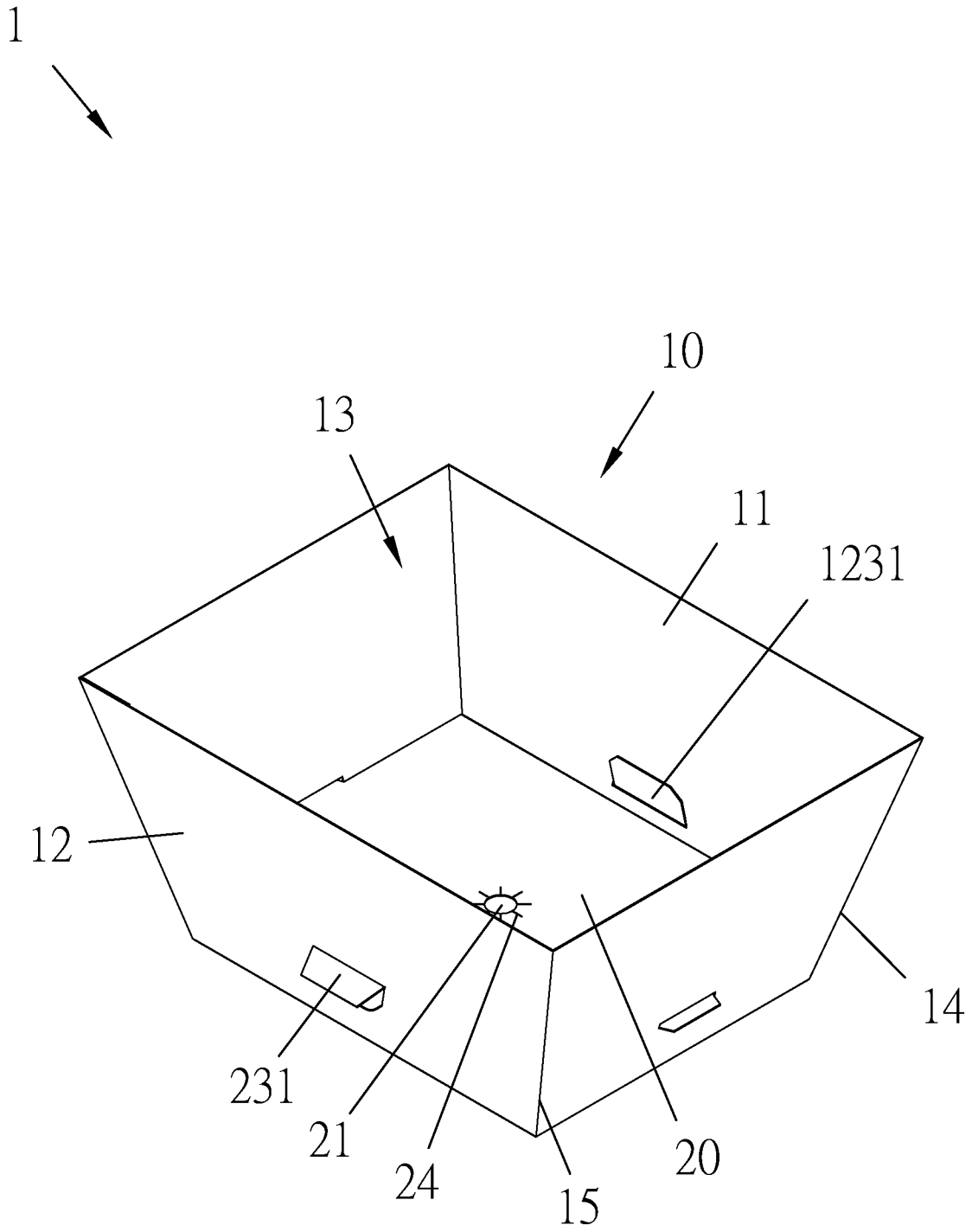
FIG. 6 is a stereoscopic appearance diagram of the third embodiment of the present invention.
Figure 7:
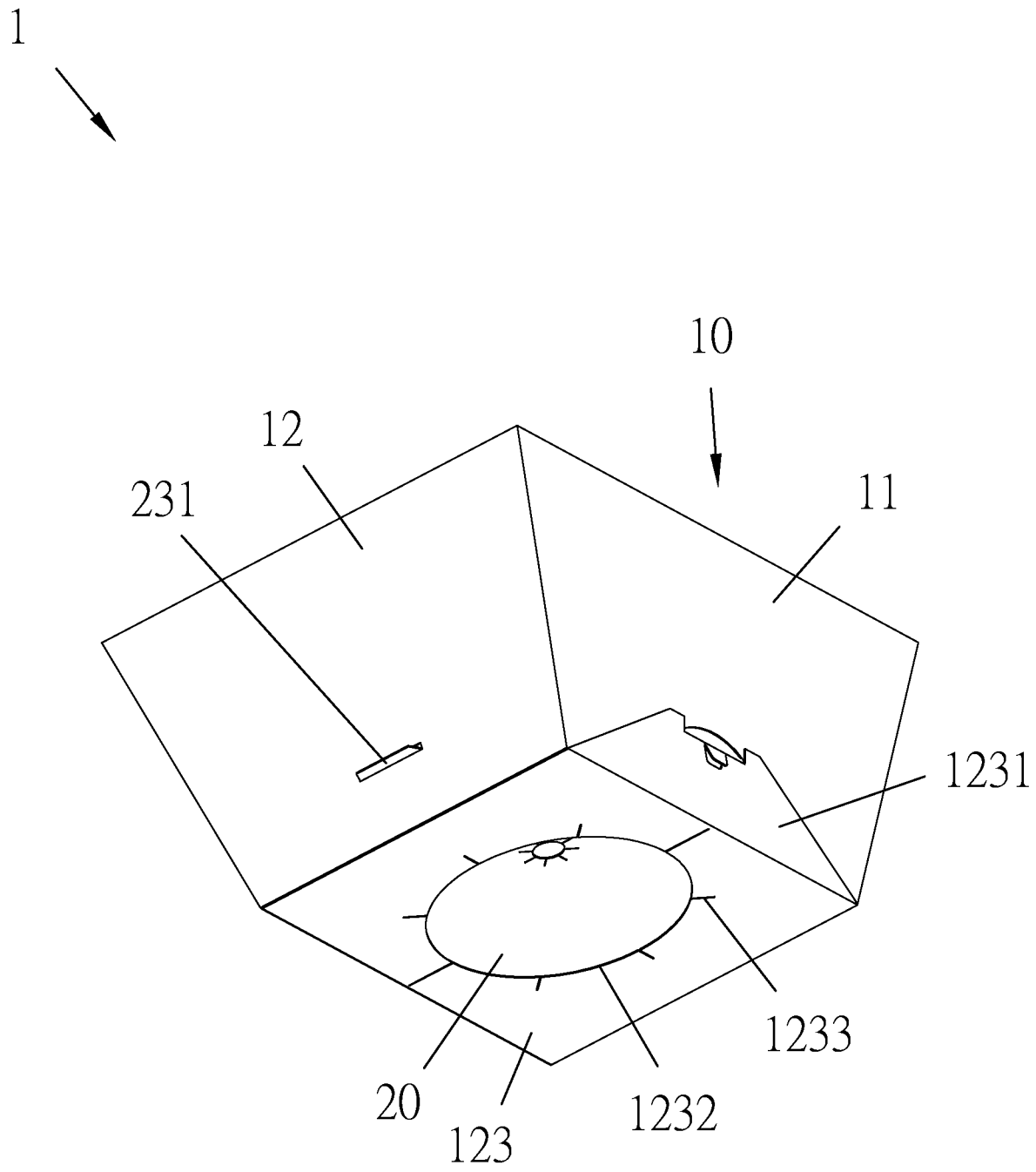
FIG. 7 is a stereoscopic appearance diagram of another perspective continuing FIG. 6.

Please refer to FIG. 6 and FIG. 7, which shows the paper food-beverage box 1 of the third embodiment of the present invention and its main structure is the same as aforementioned structure; so the same places will not be further described again.

In this embodiment, the first bending-portion 221 is combined with the bottom surface of the first side-portion 11; and the bottom surface of the second side-portion 12 extends a second box-bottom-body 123; and the other side of the second box-bottom-body 123 extends a combining-piece 1231 to combine with the first side-portion 11. A second through-hole 1232 is set in the center of the second box-bottom-body 123, and a plurality of third incisions 1233 are set at the edge of the second through-hole 1232 in interval; wherein the bottom surface of the box-bottom-body 20 has a predetermined distance from the second box-bottom-body 123.

In use, the cup-mouth of the beverage cup 30 is located between the bottom surface of the box-bottom-body 20 and the second box-bottom-body 123; and the beverage cup 30 is stuck and engaged by each of the third incisions 1233.

The paper food-beverage box 1 of the first, second and third embodiments of the present invention are all paper materials, and a plurality of folding lines are designed, so that the paper food-beverage box 1 can be folded and stored before use, thereby reducing the needed space for storage or transportation.

I claim:

1. A simple paper beverage-food box, which comprises a box-body comprising a first side-portion and a plurality of second side-portions; wherein the first side-portion and each of the second side-portions are connected with each other to form an accommodating space inside; wherein between the first side-portion and each of the second side-portions respectively has a first folding-line, and between each of the second side-portions respectively has a second folding-line; and a box-bottom-body comprising a first through-hole, a first edge-portion, and a plurality of second edge-portions; wherein the first through-hole is set at the center of the box-bottom-body, and the first edge-portion is in contact with an inner side of the first side-portion;

wherein each of the first folding-line and second folding-lines has a bottom portion that is formed with a first incision, which extends from a bottom end of said each of the first folding-line and second folding-lines to a top end that is spaced from the bottom end so as to allow a bottom part of each of the first side-portion and the second side-portions to enlarge and to elastically restore;

wherein a predetermined position of each of the second side-portions is set with a combining slot, and each of the second edge-portions is convexly set a combining-piece respectively; wherein each of the combining-piece is inserted and set in each of the combining slot, and the bottom surface of the box-bottom-body has a predetermined distance from the bottom surface of the first side-portion and the bottom surface of each of the second side-portions;

wherein the top of the first side-portion and the top of each of the second side-portions have a concave-portion; and wherein the bottom surface of the second side-portion extends a second box-bottom-body; and the other side of the second box-bottom-body extends a combining-piece to combine with the first side-portion; wherein a second through-hole is set in the center of the second box-bottom-body, and a plurality of third incisions are set at the edge of the second through-hole in interval.

2. The simple paper beverage-food box according to claim 1, wherein the top end of each of the first incisions has an arc portion.

3. The simple paper beverage-food box according to claim 1, wherein a plurality of second incisions are set at the edge of the first through-hole of the box-bottom-body in interval.

4. The simple paper beverage-food box according to claim 1, wherein the first edge-portion of the box-bottom-body is set with a first bending-portion, and the first bending-portion is abutted against the first side-portion to combine; wherein the second edge-portion of the box-bottom-body is set with a second bending-portion, and the second bending-portion is abutted against the second side-portion to combine.

* * * * *